US005078085A

United States Patent [19]

Fuji et al.

[11] Patent Number: 5,078,085

[45] Date of Patent: Jan. 7, 1992

[54] DEVELOPING PROCESS

[75] Inventors: Kazuo Fuji, Higashi; Kazuhisa Edahiro, Hirakata; Masahiko Kubo, Yao, all of Japan

[73] Assignee: Mita Industrial Co., Ltd., Osaka, Japan

[21] Appl. No.: 619,452

[22] Filed: Nov. 29, 1990

[30] Foreign Application Priority Data

Nov. 30, 1989 [JP] Japan ..... 1-308902
Nov. 30, 1989 [JP] Japan ..... 1-313246
Feb. 6, 1990 [JP] Japan ..... 2-27854

[51] Int. Cl.[5] ..... G03G 15/09

[52] U.S. Cl. ..... 118/657; 355/251; 355/77; 430/122

[58] Field of Search ..... 118/657, 658; 430/122; 355/245, 246, 251, 253, 77

[56] References Cited

U.S. PATENT DOCUMENTS 3,873,551 10/1989 Tajima et al. ..... 355/251
4,822,711 4/1989 Itaya et al. ..... 118/658
4,949,127 8/1990 Matsuda et al. ..... 355/251

*Primary Examiner*—R. L. Moses
*Attorney, Agent, or Firm*—Sherman and Shalloway

[57] ABSTRACT

Disclosed is a developing process using a two-component type developer comprising a magnetic carrier and a toner, in which the developing conditions of the two-component type developer, that is, the composition and density of the developer in a distance between a photosensitive material drum and a developing sleeve (or a distance of a developing zone), are specified based on relations of these conditions to this distance. According to this developing process, the flowability of the developer in the developing zone is improved, and furthermore, the transferability of the toner to the photosensitive material drum is improved.

10 Claims, 2 Drawing Sheets

DEVELOPING PROCESS

BACKGROUND OF THE INVENTION (1) Field of the Invention

The present invention relates to a developing process using a two-component type developer. More particularly, the present invention relates to a developing process in which an image having an excellent resolving power can be obtained without scattering of the toner or dispersion of the toner on a transfer sheet.

(2) Description of the Related Art

A two-component type developer comprising a magnetic carrier and a toner is widely used in commercial electrophotographic copying machines, and at the development of a charged image, a magnetic brush of this developer is formed on a developing sleeve having magnetic poles arranged in the interior thereof and this magnetic brush is brought into contact with a photosensitive material having the charged image to form a toner image.

In this two-component type developer, the compatibity between the toner and carrier has influences on the requirements that a sufficient density should be obtained, scattering of the toner should be prevented and these characteristics should be maintained for a long time.

In general, as the toner density increases, a high image density can be obtained, but the frictional charge of the toner becomes insufficient and the capacity of coupling with the carrier is reduced, and entrance and exit of the toner in a developing device become violent. Accordingly, a marketed tendency to increase scattering of the toner is observed. Therefore, in the conventional developing process using a two-component type developer, the toner concentration is controlled to a lower level. However, in this case, the developing efficiency is generally low and the density of a solid image area is low.

For an optimum image, it is required that the image density should be high, a fine line image area should be faithfully reproduced and the toner should not be dispersed in the periphery of the image (the dispersion of the toner in the periphery of the image will be referred to as "dispersion of the toner" hereinafter). In general, as the toner concentration increases, a high image density can be obtained, but the amount supplied of the toner in the fine line image area should naturally increase and dispersion of the toner is caused by the unnecessarily supplied toner.

As the means for overcoming this defect, Japanese Unexamined Patent Publication No. 62-63790 proposes a process in which an alternating electric field is formed between the drum and sleeve and the volume occupied by the magnetic carrier is controlled to 1.5 to 30% based on the volume between the drum and sleeve.

In this process, if the charging characteristics of the toner and carrier in the two-component type developer are sufficient, it is expected that even at a high toner concentration, the image density will be high and scattering of the toner will be controlled. However, this is substantially impossible in case of a commercial toner of developing process. More specifically, in the production of a toner, insufficient toner particles not containing a charge-controlling agent or having a low content of the charge-controlling agent should inevitably be formed at a certain ratio in the interior or exterior of a developing device. Furthermore, during the developing operation, toner particles from which the charge-controlling agent has been lost by a mechanical force or in which the content of the charge-controlling agent has been reduced are formed at a certain frequency. Moreover, uncharged toner particles in which a necessary charge is not obtained temporarily because the area ratio of an original is changed or the enviroment is changed are contained in the toner. These insufficient toner particles cause scattering of the toner. Furthermore, as the result of the investigation made by us, it was found that if the ratio of air is increased in the developing zone, an air current flowing from the upper part of the developing zone to the lower part (from the downstream side to the upstream side in the rotation direction) is generated by the mutual rotation of the photosensitive drum and developing sleeve, and scattering of the toner to the exterior of the developing device is caused by this air current.

We further found that in a developing process using a two-component type developer comprising a magnetic carrier and a toner, the flowing state of the developer passing through the developing zone is important, and that if the developing conditions are set within certain ranges relatively to this flowing state, even when the toner concentration is relatively high and a toner containing insufficiently charged particles is used, scattering of the toner can be effectively prevented.

SUMMARY OF THE INVENTION

It is therefore a primary object of the present invention to provide a developing process using a two-component type developer, in which scattering of the toner or dispersion of the toner can be prevented and excellent resolving characteristics such as increase of the image density is a solid image area and sharpening of a fine line image area can be attained.

In accordance with the present invention, there is provided a developing process comprising delivering a two-component type developer comprising a magnetic carrier and a toner to a developing zone from a developing device by a sleeve, developing an electrostatic latent image on a photosensitive material drum in the developing zone and returning the developer, which has passed through the developing zone, to the developing device, wherein the developing conditions are set so that the requirement represent by the following formula is satisfied:

$$30 < M \times (T/D \times 1/\rho t + C/D \times 1/\rho c) \div H \times 100 < 40 \quad (1)$$

wherein M represents the coated amount (g/cm$^2$) of the developer per unit area of the sleeve, H represents the distance (cm) of the line connecting the center of the photosensitive material drum to the center of the sleeve, T/D represents the concentration of the toner based on the weight of the developer, C/D represents the carrier concentration based on the weight of the toner, $\rho t$ represents the true density (g/cm$^3$) of the toner, and $\rho c$ represents the true density (g/cm$^3$) of the carrier.

In this developing process, the developing device is preferably arranged so that the requirement represented by the following formula is satisfied:

$$B > H$$

wherein H is as defined above and B represents the projection distance between the edge of an opening of the developing device on the developer return side and the sleeve, seen in the vertical direction.

In this developing process, the development is preferably performed by applying an alternating current voltage forming an alternating electric field having the same polarity as that of the electrostatic latent image and ranging from the highest voltage of the electrostatic latent image to the lowest voltage of the electrostatic latent image, between the photosensitive material drum and the developing sleeve.

In this developing process, the peripheral speed ratio K between the photosensitive material drum and the developing sleeve preferably satisfies the requirement represented by the following formula:

$$1.25\ d/X \leqq K \leqq 2d/X \quad (2)$$

wherein d represents the particle size (μm) of the magnetic carrier and X represents the saturation magnetization (emu/g).

In this developing process, preferably, the average particle size of the magnetic carrier is adjusted to 20 to 200 μm and the saturation magnetization of the magnetic carrier is adjusted to 30 to 70 emu/g.

Furthermore, in accordance with the present invention, this is provided a developing process comprising delivering a two-component type developer comprising a magnetic carrier and a toner to a developing zone from a developing device by a sleeve, developing an electrostatic latent image on a photosentsitive material drum in the developing zone and returning the developer, which has passed through the developing zone, to the developing device, wherein a spherical carrier having a circularity (D) of at least 0.9 is used as the magnetic carrier, and the developing conditions are set so that the requirement represented by the following formula is satisfied:

$$30 < M \times (T/D \times 1/\rho t + C/D \times 1/\rho c) \div H \times 100 < 50 \quad (3)$$

wherein M represents the coated amount (g/cm$^2$) of the developer per unit area of the sleeve, H represents the distance (cm) of the line connecting the center of the photosensitive material drum to the center of the sleeve, T/D represents the concentration of the toner based on the weight of the developer, C/D represents the carrier concentration based on the weight of the toner, ρt represents the true density (g/cm$^3$) of the toner, and ρc represents the true density (g/cm$^3$) of the carrier.

DETAILED DESCRIPTION OF THE PREFERRED EMBODIMENTS

Figure 1:
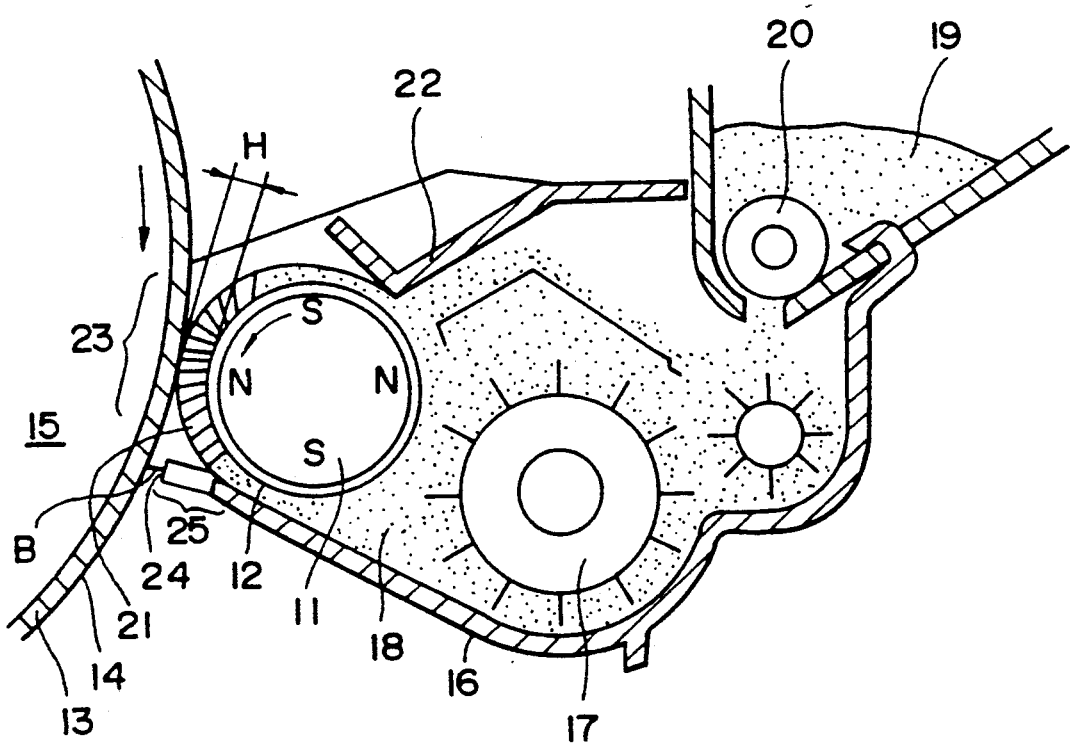
FIGS. 1 and 2 are diagrams illustrating developing apparatuses where the developing process of the present invention is worked.

The present invention is based on the finding that if the developing conditions, that is, the coated amount (M, g/cm$^2$) of the developer per unit area of the sleeve, the distance (H, cm; also called "distance D-S") of the line connecting the center of the photosensitive material drum to the center of the sleeve, the weight ratio (T/D) of the toner in the developer, the true density (ρt, cm$^3$) of the toner, the weight ratio (C/D) of the carrier in the developer and the true density (ρc, g/cm$^3$) of the carrier, are set so that the requirement represent by formula (1) is satisfied, the flowing state of the two-component type developer in the developing zone is improved, and even under developing conditions increasing the image density, scattering of the toner is effectively controlled.

R represented by the following formula is a dimensionless number which represents the occupancy volume ratio of the two-component type developer in the volume of the developing zone:

$$R = M \times (T/D \times 1/\rho t + C/D \times 1/\rho c) \div H \times 100 \quad (1a)$$

By adjusting the value R to larger than 30%, especially larger than 33%, but smaller than 40%, scattering of the toner can be effectively prevented.

If this developer occupancy ratio (R) is smaller than 30%, the volume occupied by the developer in the developing zone of distance D-S is reduced, and in this region, the magnetic brush engulfs air from above the trough in distance D-S and carries this air to below the trough to generate air current and readily cause scattering of the toner from the interior of the developing device into the copying machine. If this developer occupancy ratio (R) exceeds 40%, the developer is packed in too large an amount in the trough of distance D-S to prevent smooth flow of the developer and therefore, a considerable load is imposed on the developing sleeve, with the result that the sleeve is not smoothly rotated and a turbulence is given to the developer scattering is readily caused above the trough. In contrast, if the developer occupancy ratio (R) is within the range specified in the present invention, the developer flows smoothly through the trough of distance D-S and generation of the above-mentioned air current is prevented, and even at a high toner concentration, scattering of the toner can be effectively prevented.

Relations of the developer occupancy ratio (R) to various factors of the developing conditions are obvious from the above-mentioned formula (1a). More specifically, as the coated amount M of the developer on the sleeve increases, the value R increases, and as the distance H between D and S increases, the value R decreases. Furthermore, since the relation of $\rho t < \rho c$ is generally established, as the concentration (weight ratio) of the toner in the two-component type developer increases, the developer occupancy ratio increases.

More specifically, M is selected from the range of 0.06 to 0.25 g/cm$^2$, especially 0.1 to 0.2 g/cm$^2$, H is selected from 0.04 to 0.16 cm, especially from 0.06 to 0.14 cm, and the weight ratio of the toner in the developer is selected from 0.03 to 0.08, especially from 0.035 to 0.075, and they are combined so that R satisfies the requirement of formula (1).

In the present invention, by using a spherical carrier, the range of the developer occupancy ratio R can be broadened. The spherical carrier is excellent over an inderminate carrier in the flowability because of its shape, and in case of a spherical carrier having a circularity (D) of at least 0.9, carrier particles are uniformly and regularly arranged in the developer in the developing zone and therefore, generation of an air current is prevented and the adhesion of the carrier to the toner increases, with the result that the toner concentration can be set at a higher level. Therefore, the preferred range of the developer occupancy ratio represented by the following formula:

$$R = M \times (T/D \times 1/\rho t + C/D \times 1/\rho c) \div H \times 100$$

can be broadened to $30<R<50$. Moreover, if the spherical carrier is used, the developing pressure can be uniformalized, and the uneven image quality can be advantageously reduced. Incidentally, the circularity referred to herein is represented by the following formula (4):

$$\text{Circularity } (D) = \frac{\sqrt{r_l \cdot r_s}}{r_l} \quad (4)$$

wherein $r_l$ represents the major axis of the carrier particles and $r_s$ represents the minor axis of the carrier particles.

It has been found that scattering of the toner at the development is also influenced by the arrangement of the developing device. Accordingly to the developing process of the present invention, the two-component type developer is delivered to the developing zone of distance D-S from the developing device by the sleeve and used for developing an electrostatic latent image on the photosensitive material drum, and then, the developer is returned to the developing device. In order to perform this circulating movement of the toner smoothly without scattering of the toner, according to a preferred embodiment of the present invention, the developing device is arranged so that the requirement represented by the following formula is satisfied:

$$B>H$$

wherein H is as defined above and B represents the projection distance between the edge of an opening of the developing device on the developer return side and the sleeve, seen in the vertical direction. Namely, according to this embodiment of the present invention, even if largest scattering of the toner in the developer is caused by the centrifugal force, by arranging a developer-receiving portion having an opening having a space larger than the distance H between the drum and sleeve outwardly of the vertical projection of the edge of the sleeve, scattering of the toner to the exterior of the developing device can be prevented.

In the present invention, if the peripheral speed ratio between the photosensitive material drum and the developing sleeve is determined according to the particle size d of the carrier and the saturation magnetization x so that the requirement of formula (2) is satisfied while the developer occupancy ratio is within the above-mentioned preferred range, the sliding contact force (developing pressure) of the developer flowing in the developing zone to the photosensitive material is kept in a preferred range and the resolving power is further improved. More specifically, if the peripheral speed ratio K between the photosensitive material drum and the developing sleeve exceeds 2d/x, the sliding contact force to the photosensitive material in the developing zone becomes too large, and the toner image is disturbed and the resolving power of the obtained image is reduced. If the peripheral speed ration K is lower than 1.25d/x, when the flowing state of the developer is delicately changed according to the change of the environment, reduction of the image density and scattering of the toner are sometimes caused.

In the present invention, in the flowing state of the above-mentioned developer occupancy ratio, the magnetic brush is delicately moved by applying an alternating current voltage having the same polarity as that of the electrostatic latent image and forming an alternating electric field between the bright area voltage and dark area voltage of the electrostatic latent image, between the photosensitive material drum and the developing sleeve, whereby the contact of the magnetic brush with the drum surface is kept soft and excessive supply of the toner to a line image and disturbance of the toner image can be prevented, and simultaneously, the unnecessary toner dispersed in the non-image area is picked up. Accordingly, the reproducibility of fine lines is improved and dispersion of the toner can be controlled.

In the present invention, it is important that the peak value of the alternating current voltage forming an alternating electric field should be between the bright area voltage (lowest voltage) and dark area voltage (highest voltage) of the electrostatic latent image. If the peak voltage is too large and outside this range, pulsation of the magnetic brush becomes too violent and the image quality becomes uneven, or by scattering of the toner, fogging of the image or dispersion of the toner is caused, or dropping of carrier particles is caused.

According to the above-mentioned conventional developing process disclosed in Japanese Unexamined Patent Publication No. 62-63970, a developer having a high toner concentration is used in such a small amount that the volume ratio of the carrier in the developing zone is in the range of from 1.5 to 3, and such a high alternating current voltage that the peak voltage is higher than the bright area voltage of the electrostatic latent image and lower than the dark area voltage of the electrostatic latent image is applied to violently vibrate the magnetic brush, and in this state, the development is carried out. The delivery quantity of the developer is decreased to reduce the sliding contact pressure to the drum, and supply of the toner to the electrostatic latent image is performed by utilizing the flying force of the toner. Accordingly, this conventional developing process is substantially different from the developing process of the present invention where the toner is supplied to the electrostatic latent image and the developer is brought into contact with the electrostatic latent image while the magnetic brush of the developer is delicately moved.

In the developing process of the present invention, the alternating current voltage is such as capable of slightly moving the magnetic brush, and it is sufficient if the alternating current voltage has a peak voltage intermediate between the bright area voltage and dark area voltage of the electrostatic latent image. More specifically, it is preferred that if the dark area voltage of the electrostatic latent image is −700 V and the bright area voltage is −70 V, the alternative current voltage be applied so that the peak-to-peak voltage is from −100 to −600 V. For example, it is preferred that the peak-to-peak be formed in the range of from 60 to 90% of the voltage difference between the dark area voltage and the bright area voltage.

Referring to FIG. 1 illustrating the magnetic brush developing process, a magnetic roll 11 having many magnetic poles N and S is arranged within a developing sleeve 12 formed on a non-magnetic material such as aluminum. A photosensitive material drum 15 comprising a substrate 13 and an electrophotographic photosensitive layer 14 formed thereon is arranged with a minute clearance H from the developing sleeve 12. The developing sleeve 12 and photosensitive material drum 15 are rotatably supported on a machine frame (not shown) and they are driven so that the moving directions of the sleeve 12 and drum 15 at the nip position are the same (rotation directions are reverse to each other), as indicated by arrows. The developing sleeve 12 is located at an opening of a developing device 16, and a mixing stirrer 17 is arranged within the developing device 16 to mix and stir a two-component type developer (a mixture of a toner and a magnetic carrier) 18. A toner-supplying mechanism 20 for supplying a toner 19 is arranged above the mixing stirrer 17. The two-component type developer 18 is mixed by the stirrer 17 to impart frictional charges to the toner. Then, the developer is is supplied to the developing sleeve 12 to form a magnetic brush 21 on the surface of the sleeve 12. The ear length of the magnetic brush 21 is adjusted by a brush-cutting mechanism 22 and the magnetic brush 21 is delivered to the nip position to the electrophotographic photosensitive layer 14 to form a visible image from the electrostatic latent image by the toner 19.

The developing sleeve 12 is located at an opening of the developing device entirely represented by reference numeral 23, and the brush-cutting mechanism 22 is arranged on the supply side to the developing sleeve in the developing device 23. On the side of circulation to the developing device from the sleeve, a developer receiver 25 having an open end edge 24 is arranged.

The coated amount M of the developer can be set at a predetermined value by changing the peripheral speed of the sleeve 12 or adjusting the distance between the sleeve 12 and the brush-cutting mechanism 22.

In the present invention, conditions described below are set for setting the composition of the developer, the coated amount of the developer and the distance D-S so that the requirement of formula (1) is satisfied.

DEVELOPER

A carrier having a density $\rho c$ of 3.50 to 6.50 g/cm$^3$, especially 4.00 to 5.50 g/cm$^3$, is preferably used, though the preferred density depends to some extent on the carrier concentration C/D. A ferrite type carrier is especially preferably used.

Sintered ferrite particles composed of at least one member selected from the group consisting of zinc iron oxide ($ZnFe_2O_4$), yttrium iron oxide ($Y_3Fe_5O_{12}$), cadmium iron oxide ($CdFe_2O_4$), gadollinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$) and lanthanum iron oxide ($LaFeO_3$) have heretofore been used as the ferrite. A soft ferrite comprising at least one metal component, preferably at least two metal components, selected from the group consisting of Cu, Zn, Mg, Mn and Ni, for example, a copper/zinc/magnesium ferrite, has been especially used. Among these ferrites heretofore used, those satisfying the above-mentioned conditions are used in the present invention.

It is preferred that the saturation magnetization of the carrier be 40 to 65 emu/g, especially 45 to 56 emu/g.

A ferrite carrier satisfying the above requirements, especially a spherical ferrite carrier, is preferably used. It is preferred that the particle size of the spherical carrier be 20 to 140 μm, especially 50 to 100 μm. A spherical ferrite carrier satisfying this requirement passes through the developing zone in a much better state.

Of course, the electric resistance of the ferrite carrier is changed according to the chemical composition thereof. Furthermore, the electric resistance of the ferrite carrier is changed according to the particle structure, the preparation process and the kind and thickness of the coating. It is preferred that the volume resistivity of the ferrite carrier be $5\times10^8$ to $5\times10^{11}$ Ω-cm, especially $1\times10^9$ to $1\times10^{11}$ Ω-cm.

TONER

A toner having a density $\rho t$ of 1.00 to 1.40 g/cm$^3$, especially 1.10 to 1.20 g/cm$^3$, is preferably used, though the preferred density of the toner depends on the density of the carrier and the toner concentration.

The toner used in the present invention is formed by incorporating a colorant, a charge-controlling agent and, if desired, known toner additives into a binder resin medium. A toner having a volume resistivity of $1\times10^8$ to $3\times10^9$ Ω-cm, especially $2\times10^8$ to $8\times10^9$ Ω-cm, is preferably used, and it is preferred that the dielectric constant of the toner be 2.5 to 4.5, especially 3.0 to 4.0.

The binder resin medium, colorant, charge-controlling and other toner additives are selected and combined so that the above-mentioned characteristics are attained.

As the binder resin medium, there are generally used a styrene resin, an acrylic resin and a styrene/acrylic copolymer.

As the styrene monomer used for these resins, there can be mentioned monomers represented by the following formula:

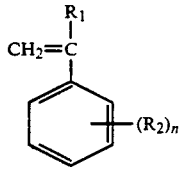

(I)

wherein $R_1$ represents a hydrogen atom, a lower alkyl group (having up to 4 carbon atoms) or a halogen atom, $R_2$ represents a substituent such as a lower alkyl group or a halogen atom, and n is an integer of up to 2, including zero, such as styrene, vinyltoluene, α-methylstyrene, α-chlorostyrene and vinylxylene, and vinylnaphthalene. Among these monomers, styrene is especially preferably used.

As the acrylic monomer, there can be mentioned monomers represented by the following formula:

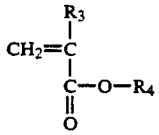

(II)

wherein $R_3$ represents a hydrogen atom or a lower alkyl group, and $R_4$ represents a hydrogen atom or an alkyl group having up to 18 carbon atoms, such as ethyl acrylate, methyl methacrlate, butyl acrylate, butyl methacrylate, 2-ethylhexyl acrylate, 2-ethylhexyl methacrylate, acrylic acid and methacrylic acid. In addition to the foregoing monomers, ethylenically unsaturated carboxylic acids and anhydrides thereof, such as maleic anhydride, fumaric acid, maleic acid, crotonic acid and itaconic acid, can be used.

A styrene/acrylic copolymer is one of preferred resin media. It is preferred that the ratio of the styrene monomer (A) to the acrylic monomer (B) be from 50/50 to 90/10, especially from 60/40 to 85/15. Preferably, the acid value of the resin used is 0 to 25. From the viewpoint of the fixing property, it is preferred that the resin used should have a glass transition temperature (Tg) of 50° to 65° C.

At least one colorant selected from inorganic and organic pigments and dyes, for example, carbon blacks such as furnace black and channel black, iron blacks such as triiron Lextraoxide, titanium dioxides such as rutile titanium oxide and anatase titanium oxide, Phthalocyanine Blue, Phthalocyanine Green, cadmium yellow, molybdenum orange, Pyrazolone Red and Fast Violet B, is used as the colorant to be incorporated into the resin.

Known charge-controlling agents, for example, oil-soluble dyes such as Nigrosine Base (C.I. 50415), oil Black (C.I. 20150) and Spiron Black, 1/1 or 2/2 metal complex dyes, metal salts of naphthenic acid, fatty acids, soaps, resin acids and resin acid soaps, can be used as the charge-controlling agent.

It is preferred that the particle size of the toner particles be such that the volume median diameter is 8 to 14 μm, especially 10 to 12 μm, as measured by a Coulter Counter. The particle shape may be either an indermi-nate shape formed by melt kneading and pulverization, or a spherical shape formed by dispersion or suspension polymerization.

The weight concentration T/D in the developer is preferably 0.03 to 0.08, especially preferably 0.035 to 0.075.

In order to attain the objects of the present invention, it is preferred that the electric resistance of the developer as a whole be $1\times10^9$ to $1\times10^{11}$ Ω-cm, especially $5\times10^9$ to $5\times10^{10}$ Ω-cm.

OTHER DEVELOPING CONDITIONS

The coated amount M of the developer is preferably adjusted within the above-mentioned range, and this coated amount depends on the peripheral speed of the developing speed, the flux density of the developing sleeve and the cut length of the magnetic brush. From this viewpoint, it is preferred that magnetic poles of the developing sleeve should have a flux density of 500 to 1000 gauss, especially 650 to 850 gauss. The peripheral speed of the developing sleeve is preferably 60 to 800 cm/sec, especially preferably 90 to 450 cm/sec. and the cut length of the magnetic brush is preferably 0.6 to 1.6 mm, especially preferably 0.8 to 1.4 mm, though the preferred cut length of the magnetic brush is changed to some extent according to the flux density.

It is preferred that the distance H of D-S be selected within the range of from 0.4 to 1.6 mm, especially from 0.6 to 1.4 mm. Incidentally, in the present invention, in the case where the weight ratio T/D of the toner in the developer is increased, scattering of the toner can be effectively prevented by reducing the coated amount M of the developer and increasing the distance H of D-S.

All of photosensitive materials customarily used for the electrophotography, for example, a selenium photosensitive material, an amorphous silicon photosensitive material, a zinc oxide photosensitive material, a cadmium selenide photosensitive material, a cadmium sulfide photosensitive material and various organic photosensitive materials can be used in the present invention.

The bias voltage applied between the developing sleeve and the electroconductive substrate of the photosensitive material drum is preferably such that the average electric field intensity is 100 to 1000 V/mm, especially 125 to 700 V/mm. It also is preferred that an alternating voltage be applied.

Figure 2:
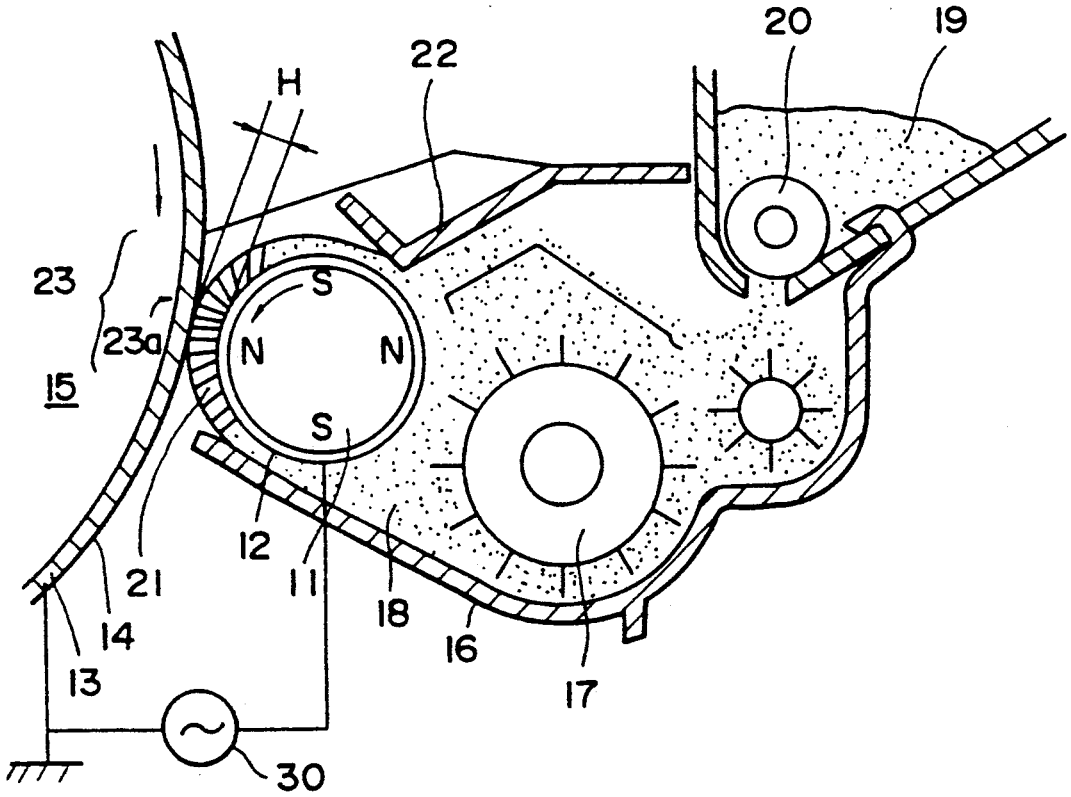

FIG. 2 is a diagram illustrating developing apparatus to be used for working the developing process of the present invention, and the apparatus shown in FIG. 2 has a structure similar to the structure of the developing apparatus shown in FIG. 1. Members similar to those shown in FIG. 1 are represented by the same reference numerals as used in FIG. 1 and detailed explanation of these members is omitted.

The developing apparatus shown in FIG. 2 is different from the developing apparatus shown in FIG. 1 in that an alternating current voltage-applying device 30 is arranged between the developing sleeve and the photosensitive material drum.

A peak voltage having a certain amplitude is applied from the alternating current voltage-applying device 30 and the average value of this voltage depends on the above-mentioned bias voltage and the like, and there is a peak voltage between the bright area voltage of the electrostatic latent image and the dark area voltage of the electrostatic latent image. For example, when the dark area voltage of the electrostatic latent image is −700 V and the bright area voltage is −70 V, it is preferred that the voltage be applied so that the peak-to-peak voltage is −100 to −600 V, and for example, it is preferred that the peak-to-peak be formed in the range of from 60 to 90% of the voltage difference between the dark area voltage and the bright area voltage.

As is apparent from the foregoing description, according to the present invention, in the development with a magnetic brush of a two-component type developer comprising a magnetic carrier and a toner, the developing conditions, that is, the composition of the developer, the coated amount of the developer and the distance between the drum and the sleeve, are selected within specific ranges so that the requirement represented by the above-mentioned general formula (1) is satisfied, whereby a good flowing state can be imparted to the developer passing through the developing zone, and an image having a high density, especially a high density in a solid image area, can be formed while preventing scattering of the toner. Furthermore, in addition to the above-mentioned effect of improving the flowing state of the developer, there can be attained an effect of preventing generation of an air current between the photosensitive material drum and the developing sleeve. Moreover, by applying an alternating current voltage having a certain amplitude, dispersion of the toner in the periphery of the image can be effectively prevented and the resolving power can be increased by sharpening the fine line image area.

The present invention will now be described in detail with reference to the following examples.

EXAMPLE 1

Runs 1-1 through 1-12 were carried out in a remodelled machine (having the structure shown in FIG. 1) of Laser Printer LPX-1 supplied by Mita Kogyo while adjusting the distance H (or distance D-S) between the photosensitive drum and the developing sleeve and the amount M of the developer coated on the developing sleeve as shown in Table 1.

A toner formed by dispersing carbon black into a binder resin composed mainly of a polyester was used, and the true density t and weight concentration T/D of the toner were changed in runs 1-1 through 1-12 as shown in Table 1.

A ferrite carrier was used as the carrier, and the true density c and weight concentration C/D of the carrier were changed in Runs 1-1 through 1-12 as shown in Table 1.

In each of runs 1-1 through 1-12, the copying test was carried out to obtain 10000 copies. The obtained results are shown in Table 1.

TABLE 1

| Run No. | Coated Amount M ($g/cm^2$) | T/D (%) | C/D (%) | ρt ($g/cm^3$) | ρc ($g/cm^3$) | H (cm) | R (%) | Results of Printing Test |
|---|---|---|---|---|---|---|---|---|
| 1-1 | 0.101 | 5 | 95 | 1.11 | 5 | 0.055 | 43.2 | uneven density, scattering of toner |
| 1-2 | 0.101 | 5 | 95 | 1.11 | 5 | 0.070 | 33.9 | high-density sharp image |
| 1-3 | 0.101 | 5 | 95 | 1.11 | 5 | 0.085 | 27.9 | scattering toner |
| 1-4 | 0.11 | 5 | 95 | 1.11 | 5 | 0.075 | 34.5 | high-density sharp image |
| 1-5 | 0.11 | 5 | 95 | 1.11 | 3.5 | 0.08 | 43.5 | uneven density scattering of toner |
| 1-6 | 0.11 | 5 | 95 | 1.11 | 3.5 | 0.12 | 29.0 | scattering of toner |
| 1-7 | 0.11 | 5 | 95 | 1.11 | 3.5 | 0.10 | 34.8 | high-density sharp image |
| 1-8 | 0.11 | 5 | 95 | 1.11 | 5.5 | 0.07 | 34.2 | high-density sharp image |
| 1-9 | 0.11 | 3 | 97 | 1.11 | 5 | 0.07 | 34.7 | high-density sharp image |
| 1-10 | 0.11 | 8 | 92 | 1.11 | 5 | 0.07 | 40.2 | uneven density, scattering of toner |
| 1-11 | 0.11 | 8 | 92 | 1.11 | 5 | 0.08 | 35.0 | high-density sharp image |
| 1-12 | 0.11 | 8 | 92 | 1.11 | 5 | 1.00 | 28.2 | scattering of toner |

EXAMPLE 2

Runs 2-1 through 2-12 were carried out in a remodelled machine (having the structure shown in FIG. 1) of Laser Printer LPX-1 supplied by Mita Kogyo while adjusting the distance H (or distance D-S) between the photosensitive drum and the developing sleeve and the amount M of the developer coated on the developing sleeve as shown in Table 2.

A toner formed by dispersing carbon black into a binder resin composed mainly of a polyester was used, and the true density t and weight concentration T/D of the toner were changed in runs 2-1 through 2-12 as shown in Table 2.

A ferrite carrier was used as the carrier, and the circularity of the carrier was lower than 0.9 in runs 2-1 through 2-6, 2-10 and 2-12, 0.93 in run 2-7, 0.940 in run 2-8, 0.93 in run 2-9 and 0.95 in run 2-11.

The particle size, saturation magnetization, true density c and weight concentration C/D were changed in runs 2-1 through 2-12 as shown in Table 2.

The copying test was carried out under developing conditions of runs 2-1 through 2-12 shown in Table 2, and the density of the solid image area, scattering of the toner and the resolving power were evaluated. The obtained results are shown in Table 2.

From the results shown in Table 2, it is understood that if a spherical carrier having a circularity of at least 0.9 is used, the preferable range of the developer occupancy ratio R is broadened.

TABLE 2

| Run No. | Coated Amount | Weight Ratio of Toner | True Density of Toner | Weight Ratio of Carrier | True Density of Carrier | Saturation Magnetization of Carrier | Particle Size of Carrier | Distance D-S | Developer Occupancy Ratio |
|---|---|---|---|---|---|---|---|---|---|
| 2-1 | 0.101 | 0.05 | 1.11 | 0.95 | 5.0 | 40 | 40 | 0.055 | 43.2 |
| 2-2 | 0.101 | 0.05 | 1.11 | 0.95 | 5.0 | 45 | 80 | 0.070 | 33.9 |
| 2-3 | 0.101 | 0.05 | 1.11 | 0.95 | 5.0 | 55 | 85 | 0.085 | 27.9 |
| 2-4 | 0.110 | 0.05 | 1.11 | 0.95 | 3.5 | 55 | 85 | 0.080 | 38.5 |
| 2-5 | 0.110 | 0.05 | 1.11 | 0.95 | 3.5 | 55 | 85 | 0.120 | 28.8 |
| 2-6 | 0.140 | 0.08 | 1.15 | 0.92 | 5.5 | 64 | 70 | 0.080 | 41.5 |
| 2-7 | 0.140 | 0.08 | 1.15 | 0.92 | 5.5 | 64 | 70 | 0.080 | 41.5 |
| 2-8 | 0.115 | 0.07 | 1.13 | 0.93 | 5.0 | 50 | 90 | 0.090 | 31.7 |
| 2-9 | 0.140 | 0.10 | 1.13 | 0.90 | 5.0 | 45 | 80 | 0.070 | 54.2 |
| 2-10 | 0.110 | 0.05 | 1.11 | 0.95 | 5.0 | 50 | 95 | 0.110 | 23.5 |
| 2-11 | 0.110 | 0.08 | 1.11 | 0.92 | 5.8 | 55 | 95 | 0.080 | 31.6 |
| 2-12 | 0.101 | 0.07 | 1.13 | 0.93 | 4.5 | 60 | 75 | 0.090 | 35.7 |

| Run No. | Peripheral Speed Ratio | 1.25 d/x | 2 d/X | Density of Solid Image Area | Scattering of Toner and Fogging | Resolving Power |
|---|---|---|---|---|---|---|
| 2-1 | 2.9 | 1.25 | 2 | 1.85 | X | 3.6 |
| 2-2 | 2.6 | 2.22 | 3.56 | 1.81 | ○ | 4.5 |
| 2-3 | 1.8 | 1.93 | 3.09 | 1.73 | X | 4.5 |
| 2-4 | 2.0 | 1.93 | 3.09 | 1.90 | ○ | 5.0 |
| 2-5 | 2.2 | 1.93 | 3.09 | 1.80 | X | 4.5 |
| 2-6 | 2.3 | 1.37 | 2.19 | 1.83 | X | 3.6 |
| 2-7 | 2.0 | 1.37 | 2.19 | 1.82 | ○ | 5.0 |
| 2-8 | 2.5 | 2.25 | 3.60 | 1.81 | Δ | 4.5 |
| 2-9 | 3.2 | 2.22 | 3.56 | 1.91 | X | 3.6 |
| 2-10 | 3.9 | 2.37 | 3.80 | 1.75 | X | 3.6 |
| 2-11 | 2.2 | 2.15 | 3.45 | 1.78 | X | 4.0 |
| 2-12 | 2.0 | 1.56 | 2.50 | 1.91 | ○ | 5.6 |

NOTE

In Table 2, the units of the coated amount, the true density of the toner, the true density of the carrier, the saturation magnetization, the particle size and the distance D-S were $g/cm^2$, $g/cm^3$, $g/cm^3$, cmu/g, μm and cm, respectively. The density of the solid image area was measured by a densitometer (supplied by Sakura). The density of the solid image area is preferably in the range of from 1.80 to 2.0. The unit of the resolving power was lines per mm.

EXAMPLE 3

Runs 3-1 through 3-12 were carried out in a remodelled machine (having the structure shown in FIG. 2) of Laser Printer LPX-1 supplied by Mita Kogyo while adjusting the distance H (or distance D-S) between the photosensitive drum and the developing sleeve and the amount M of the developer coated on the developing sleeve as shown in Table 3, while the bright area voltage was adjusted to −700 V and the dark area voltage was adjusted to −70 V.

A toner formed by dispersing carbon black into a binder resin composed mainly of a polyester was used, and the true density ρt and weight concentration T/D of the toner were changed in runs 3-1 through 3-12 as shown in Table 3.

A ferrite carrier was used as the carrier, and the particle size, saturation magnetization true density c and weight concentration C/D of the carrier were changed in runs 3-1 through 3-12 as shown in Table 3.

In each of runs 3-1 through 3-12, the copying test was carried out under conditions shown in Table 3, and the density of the solid image area, scattering of the toner and the resolving power were evaluated. The obtained results are shown in Table 3.

TABLE 3

| Run No. | Coated Amount | Weight Ratio of Toner | True Density of Toner | Weight Ratio of Carrier | True Density of Carrier | Distance D-S | Developer Occupancy Ratio | Peak-to-Peak of Alternating Current Voltage [(V)~(V)] |
|---|---|---|---|---|---|---|---|---|
| 3-1 | 0.101 | 0.05 | 1.11 | 0.95 | 5.0 | 0.055 | 43.2 | −100~−650 |
| 3-2 | 0.101 | 0.05 | 1.11 | 0.95 | 5.0 | 0.070 | 33.9 | −150~−650 |
| 3-3 | 0.101 | 0.05 | 1.11 | 0.95 | 5.0 | 0.085 | 27.9 | −100~−650 |
| 3-4 | 0.110 | 0.05 | 1.11 | 0.95 | 3.5 | 0.080 | 38.5 | −100~−600 |
| 3-5 | 0.110 | 0.05 | 1.11 | 0.95 | 3.5 | 0.120 | 28.8 | −100~−750 |
| 3-6 | 0.140 | 0.08 | 1.15 | 0.92 | 5.5 | 0.080 | 41.5 | −100~−650 |
| 3-7 | 0.140 | 0.08 | 1.15 | 0.92 | 5.5 | 0.080 | 41.5 | −150~−800 |
| 3-8 | 0.115 | 0.07 | 1.13 | 0.93 | 5.0 | 0.090 | 31.7 | −150~−680 |
| 3-9 | 0.140 | 0.10 | 1.13 | 0.90 | 5.0 | 0.070 | 54.2 | −50~−750 |
| 3-10 | 0.110 | 0.05 | 1.11 | 0.95 | 5.0 | 0.110 | 23.5 | −100~−600 |
| 3-11 | 0.110 | 0.08 | 1.11 | 0.92 | 5.8 | 0.080 | 31.6 | −150~−600 |
| 3-12 | 0.101 | 0.07 | 1.13 | 0.93 | 4.5 | 0.090 | 35.7 | −80~−680 |

| Run No. | Density of Solid Image Area | Scattering of Toner and Fogging | Resolving Power | Dispersion of Toner | Remarks |
|---|---|---|---|---|---|
| 3-1 | 1.84 | X | 3.6 | X | uneven density |
| 3-2 | 1.83 | ○ | 5.0 | ○ | |
| 3-3 | 1.73 | Δ | 4.5 | X | |
| 3-4 | 1.90 | ○ | 5.0 | Δ | |
| 3-5 | 1.80 | X | 4.5 | X | |
| 3-6 | 1.86 | X | 3.6 | X | |
| 3-7 | 1.83 | X | 4.0 | X | |
| 3-8 | 1.82 | ○ | 4.5 | ○ | |
| 3-9 | 1.90 | X | 3.6 | X | development with carrier |
| 3-10 | 1.64 | X | 4.5 | ○ | |
| 3-11 | 1.81 | Δ | 4.5 | ○ | |
| 3-12 | 1.91 | ○ | 5.6 | ○ | |

NOTE

In Table 3, the units of the coated amount, the true density of the toner, the true density of the carrier, the saturation magnetization, the particle size and the distance D-S were g/cm$^2$, g/cm$^3$, g/cm$^3$, emu/g, μm and cm, respectively. The density of the solid image area was measured by a densitometer (supplied by Sakura). The density of the solid image area is preferably in the range of from 1.80 to 2.0. The unit of the resolving power was lines per mm. Dispersion of the toner was evaluated by an image analyzer.

We claim:

1. A developing process comprising delivering a two-component type developer comprising a magnetic carrier and a toner to a developing zone from a developing device by a sleeve, developing an electrostatic latent image on a photosensitive material drum in the developing zone and returning the developer, which has passed through the developing zone, to the developing device, wherein the developing conditions are set so that the requirement represented by the following formula is satisfied:

$$30 < M \times (T/D \times 1/\rho t + C/D \times 1/\rho c) - H \times 100 < 40$$

wherein M represents the coated amount (g/cm$^2$) of the developer per unit area of the sleeve, H represents the distance (cm) of the line connecting the center of the photosensitive material drum to the center of the sleeve, T/D represents the concentration of the toner based on the weight of the developer, C/D represents the carrier concentration based on the weight of the toner, ρt represents the true density (g/cm$^3$) of the toner, and ρc represents the true density (g/cm$^3$) of the carrier.

2. A developing process according to claim 1, wherein the developing device is arranged so that the requirement represented by the following formula is satisfied:

$$B > H$$

wherein H is as defined in claim 1 and B represents the projection distance between the edge of an opening of the developing device on the developer return side and the sleeve, seen in the vertical direction.

3. A developing process according to claim 1 or 2, wherein the development is performed by applying an alternating current voltage forming an alternating electric field having the same polarity as that of the electrostatic latent image and ranging from the highest voltage of the electrostatic latent image to the lowest voltage of the electrostatic latent image, between the photosensitive material drum and the developing sleeve.

4. A developing process according to claim 3, wherein the peripheral speed ratio K between the photosensitive material drum and the developing sleeve satisfies the requirement represented by the following formula:

$$1.25d/X \leqq K \leqq 2d/X$$

wherein d represents the particles size (μm) of the magnetic carrier and X represents the saturation magnetization (emu/g).

5. A developing process according to claim 4, wherein the average particle size of the magnetic carrier is adjusted to 20 to 200 μm and the saturation magnetization of the magnetic carrier is adjusted to 30 to 70 emu/g.

6. A developing process comprising delivering a two-component type developer comprising a magnetic carrier and a toner to a developing zone from a developing device by a sleeve, developing an electrostatic latent image on a photosensitive material drum in the developing zone and returning the developer, which has passed through the developing zone, to the developing device, wherein a spherical carrier having a circularity (D) of at least 0.9 is used as the magnetic carrier, and the developing conditions are set so that the requirement represented by the following formula is satisfied:

$$30 < M \times (T/D \times 1/\rho t + C/D \times 1/\rho c) \div H \times 100 < 50$$

wherein M represents the coated amount (g/cm$^2$) of the developer per unit area of the sleeve, H represents the distance (cm) of the line connecting the center of the photosensitive material drum to the center of the sleeve, T/D represents the concentration of the toner based on the weight of the developer, C/D represents the carrier concentration based on the weight of the toner, $\rho t$ represents the true density (g/cm$^3$) of the toner, and $\rho c$ represents the true density (g/cm$^3$) of the carrier.

7. A developing process according to claim 6, wherein the developing device is arranged so that the requirement represented by the following formula is satisfied:

$$B > H$$

wherein H is as defined in claim 6 and B represents the projection distance between the edge of an opening of the developing device on the developer return side and the sleeve, seen in the vertical direction.

8. A developing process according to claim 6 or 7, wherein the development is performed by applying an alternating current voltage forming an alternating electric field having the same polarity as that of the electrostatic latent image and ranging from the highest voltage of the electrostatic latent image to the lowest voltage of the electrostatic latent image, between the photosensitive material drum and the developing sleeve.

9. A developing process according to claim 6 or 8, wherein the peripheral speed ratio K between the photosensitive material drum and the developing sleeve satisfies the requirement represented by the following formula:

$$1.25d/X \leqq K \leqq 2d/X$$

wherein d represents the particles size (μm) of the magnetic carrier and X represents the saturation magnetization (emu/g).

10. A developing process according to claim 9, wherein the average particles size of the magnetic carrier is adjusted to 20 to 200 μm and the saturation magnetization of the magnetic carrier is adjusted to 30 to 70 emu/g.

* * * * *

UNITED STATES PATENT AND TRADEMARK OFFICE

CERTIFICATE OF CORRECTION

PATENT NO. 5,078,085

DATED January 7, 1992

INVENTOR(S) KAZUO FUJI, ET AL.

It is certified that error appears in the above-identified patent and that said Letters Patent is hereby corrected as shown below:

column 14, line 23, (claim 1), "toner" should read --developer--.

column 16, line 2, (claim 6), "toner" should read --developer--.

Signed and Sealed this

Seventeenth Day of August, 1993

Bruce Lehman

*Attest:*

BRUCE LEHMAN

*Attesting Officer*

*Commissioner of Patents and Trademarks*